US006401671B1

(12) United States Patent
Leathwaite

(10) Patent No.: US 6,401,671 B1
(45) Date of Patent: Jun. 11, 2002

(54) DRAW ROTARY ENGINE

(76) Inventor: Malcolm Leathwaite, 4 Stanley Place, Shotton, Deeside Flintshire, CH5 1BQ (GB)

( * ) Notice: Subject to any disclaimer, the term of this patent is extended or adjusted under 35 U.S.C. 154(b) by 0 days.

(21) Appl. No.: 09/701,916

(22) PCT Filed: May 10, 1999

(86) PCT No.: PCT/GB99/01463

§ 371 (c)(1),
(2), (4) Date: Dec. 5, 2000

(87) PCT Pub. No.: WO00/60224

PCT Pub. Date: Oct. 12, 2000

(30) Foreign Application Priority Data

Apr. 6, 1999 (GB) ..... 9907589

(51) Int. Cl.[7] ..... F02B 57/00

(52) U.S. Cl. ..... 123/43 AA; 123/43 A; 91/501; 417/269; 92/33

(58) Field of Search ..... 423/43 AA; 123/43 A; 91/501, 502, 499; 417/269; 92/33

(56) References Cited

U.S. PATENT DOCUMENTS 968,969 A * 8/1910 Ord ..... 91/501
1,604,474 A * 10/1926 Nisbet ..... 91/501
1,614,476 A * 1/1927 Hutchinson ..... 123/43 AA
2,949,100 A * 8/1960 Petersen ..... 123/43 AA
4,022,167 A * 5/1977 Kristiansen ..... 123/43 AA
4,157,079 A * 6/1979 Kristiansen ..... 123/43 AA
RE30,565 E * 4/1981 Kristiansen ..... 123/43 AA
5,103,778 A * 4/1992 Usich, Jr. ..... 123/43 AA
5,209,190 A * 5/1993 Paul ..... 123/43 AA

FOREIGN PATENT DOCUMENTS

CH 623631 * 6/1981 ..... 91/499

* cited by examiner

*Primary Examiner*—Thomas Denion
*Assistant Examiner*—Thai-Ba Trieu
(74) *Attorney, Agent, or Firm*—Collard & Roe, P.C.

(57) ABSTRACT

A reciprocating piston rotary internal combustion engine; comprising a non-rotating circular cylinder engine block containing a rotor on which piston reciprocate at right angles to the direction of centrifugal force, and parallel with the rotor, and at right angles to the direction of rotation of the rotor. These pistons form three sides of the combustion chamber and the combustion chamber ignition blocks, which are built on the rotor along with rotor form two more sides, finally the cylinder forms the sixth side. Compression and decompression is affected by cams on front and back plates guiding pistons by means of cam followers built into the pistons. By altering cams one can produce variable delays (pauses) between the strokes of the combustion cycle or change the number of strokes in a given combustion cycle. The rotor can have the blanks recessed to allow for counterbalances to be inserted, and pistons can have guide rails added to take the counterbalances.

8 Claims, 8 Drawing Sheets

DRAW ROTARY ENGINE

This invention relates to an internal combustion rotary engine, either spark ignition or fuel injection.

BACKGROUND OF THE INVENTION

Internal combustion rotary engines are well known and there are four general categories; (1) Cat- and Mouse (or scissor) engines; (2) Eccentric-rotor engines; (3) Multiple-rotor engines; (4) Revolving block engines, which combine reciprocating piston and rotary motion.

The problems with Cat and Mouse engines were stop and go forces, gas seal and lubrication. The problems with eccentric—rotor engines were retained burnt gases reducing engine performance and pollution of the air. Multirotor engines have low efficiency, difficulty sealing and high rubbing velocities. The revolving engine block engine's' biggest problem is the revolving engine block.

BRIEF SUMMARY OF THE INVENTION

According to the present invention there are provided reciprocating pistons (any number of) laid on a rotor. The pistons rotating concentrically with the rotor, inside an annulus formed by the rotor and a non-revolving circular cylinder engine block with means of ignition and inlet and exhaust of gases.

The rotor may or may not have recesses for the purpose of housing counterbalance weights to the pistons. Counterbalance weights would be attached to the rotor.

The pistons reciprocate along the length of the rotor, parallel with the rotor, at right angles to the direction of rotation of the rotor, and are known as Draw pistons. The cam following Draw pistons are arc shaped over their width, and straight over their length with a hollow centre, and may or may not have in depth a guide rail attached for the purpose of being counterbalanced.

A Draw piston forms three sides of a combustion chamber, the rotor with built in combustion chamber ignition blocks forms two more sides, finally the circular cylinder engine block forms the sixth side. Draw pistons drive their rotor forward by pushing against it.

The Draw piston's motions of compression and expansion are guided by cams and the pistons reciprocate on a path at right angles to the direction of the rotor's centrifugal force. The cams are situated on the cylinder's front and back plates. The cams can give the pistons a four or six stroke combustion cycle, with one or more cycles per revolution. The fifth and sixth strokes are used as a flushing stroke and second exhaust stroke, and for cooling purposes. The cams can also allow pauses of variable lengths (degrees) between strokes, to allow for combustion time lags and inlet and exhaust time lags.

The pistons are held by the rotor in the direction of rotation, and either by the cylinder engine block against the direction of centrifugal force, or by a part of the rotor, or by counterbalance weights against the direction of centrifugal force.

A specific embodiment of the invention will now be described by way of example, drawn free hand as a representation and not to any scale, of a three piston six chambered version, with reference to the accompanying drawings, in which:

DETAILED DESCRIPTION OF THE DRAWINGS

Figure 1:
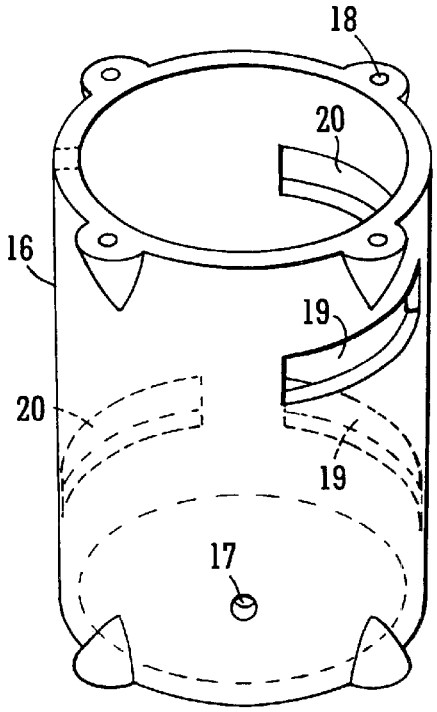
FIG. 1 shows in perspective the circular cylinder block.
Figure 2:
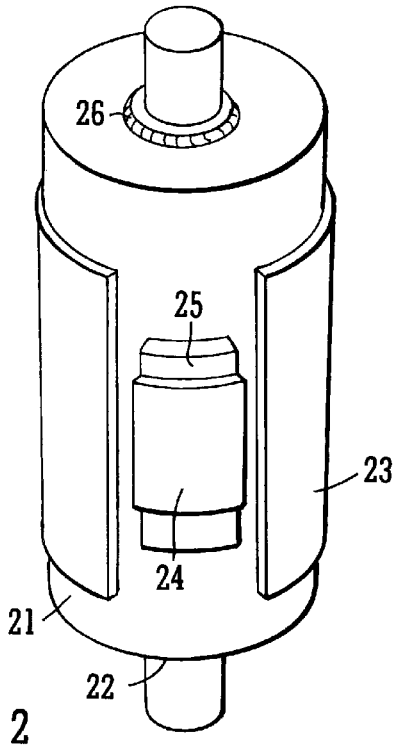
FIG. 2 shows in perspective the basic rotor.
Figure 3:
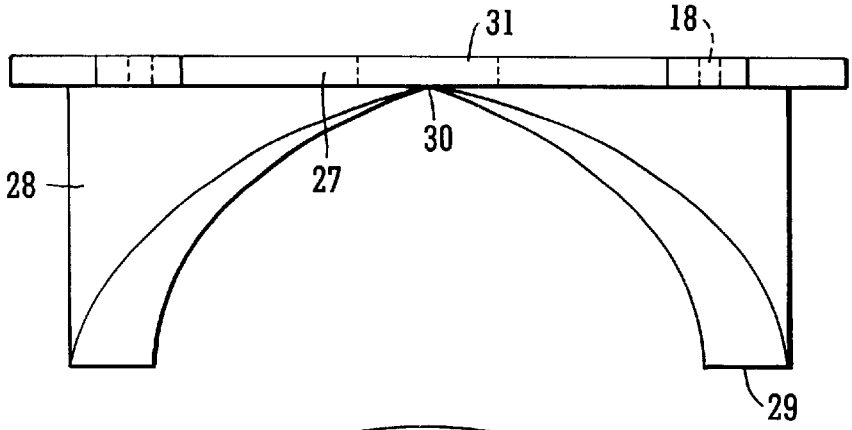
FIG. 3 shows the side view of the two cammed four stroked cycle, without pauses, front or back plate.
Figure 4:
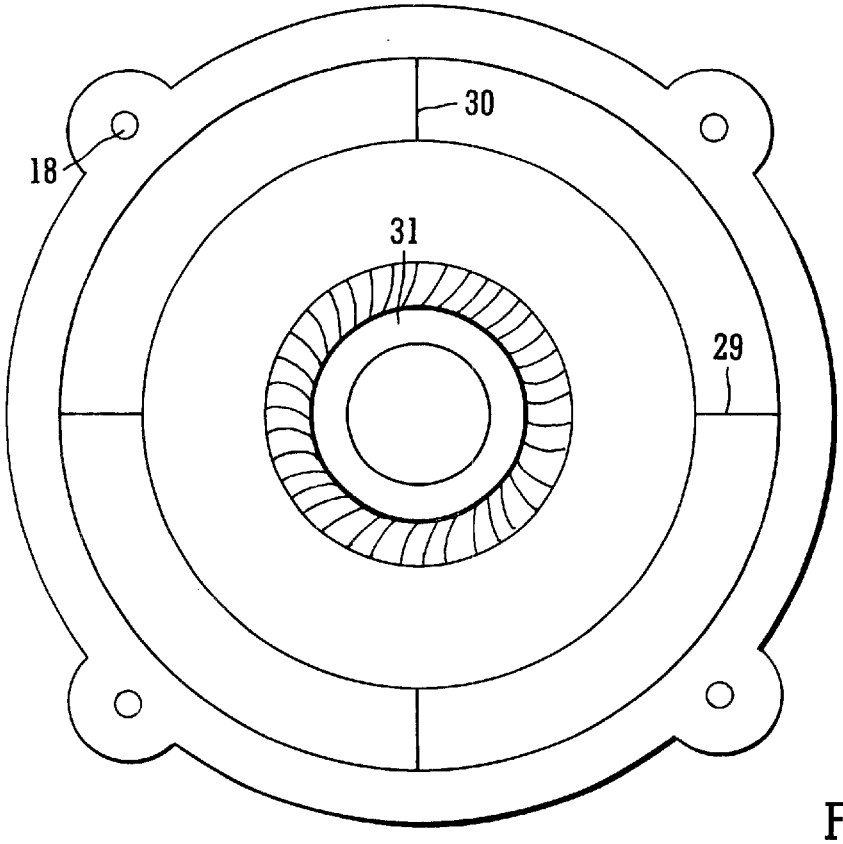
FIG. 4 shows the inside face view of a two cammed four stroked cycle, without pauses, front or back plate.

Referring to the drawings, especially FIGS. 1 to 7, the Draw piston rotary engine comprises a non moving cylindrical engine block 16 (shown in FIG. 1) with a hole 17 for spark plug or fuel injector and holes 18 for bolts with inlet ports 19 and exhaust ports 20. Inside this fits a rotor 21 (shown in FIG. 2) with shaft 22. On the shaft 22 of the rotor 21 is provided the rotating half of a vaned rotor pump 26 for lubrication purposes. Blanks 23 are formed on the rotor's surface, such blanks depend on the number of pistons desired or engine block circumference desired. Also on the rotor's surface is provided combustion chamber blocks 24 with ignition recess 25 around which blocks 24 pistons 32 (shown in FIG. 7) fit.

Figure 8:
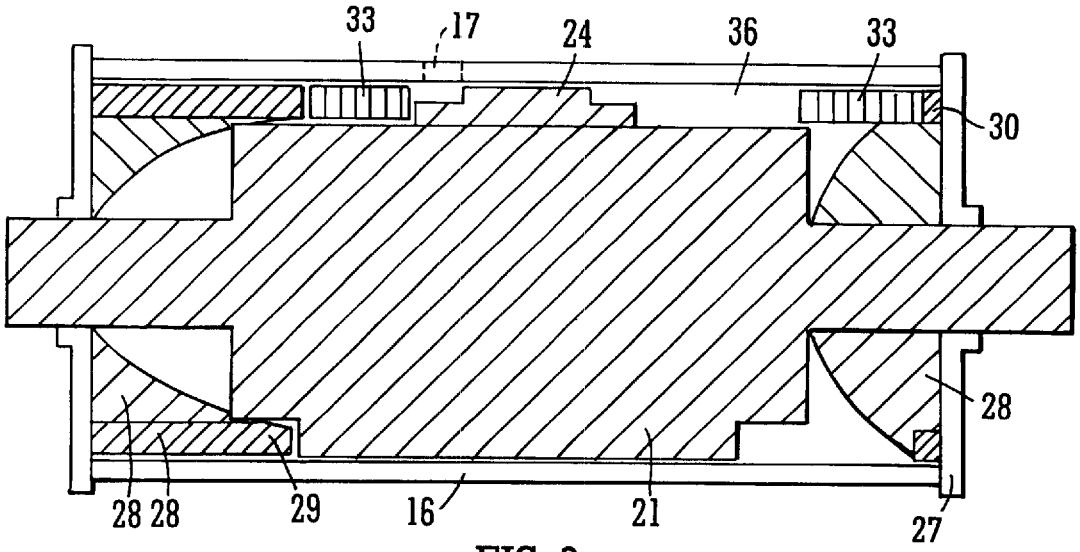
FIG. 8 shows a cross-sectional representation of Draw Rotary Engine.

As shown in FIG. 8, at either end of the cylindrical engine block 16 is fitted front and back plates 27 both identical and doing the same job. On these front and back plates 27 are provided cams 28 having heads 29 and bases 30. The cams 28 guide the reciprocating pistons 32. The cams 28 may have flat areas or pauses 37 on the heads 29 and bases 30 of the cams to provide delays of variable length (degrees) between reciprocating strokes.

Figure 11:
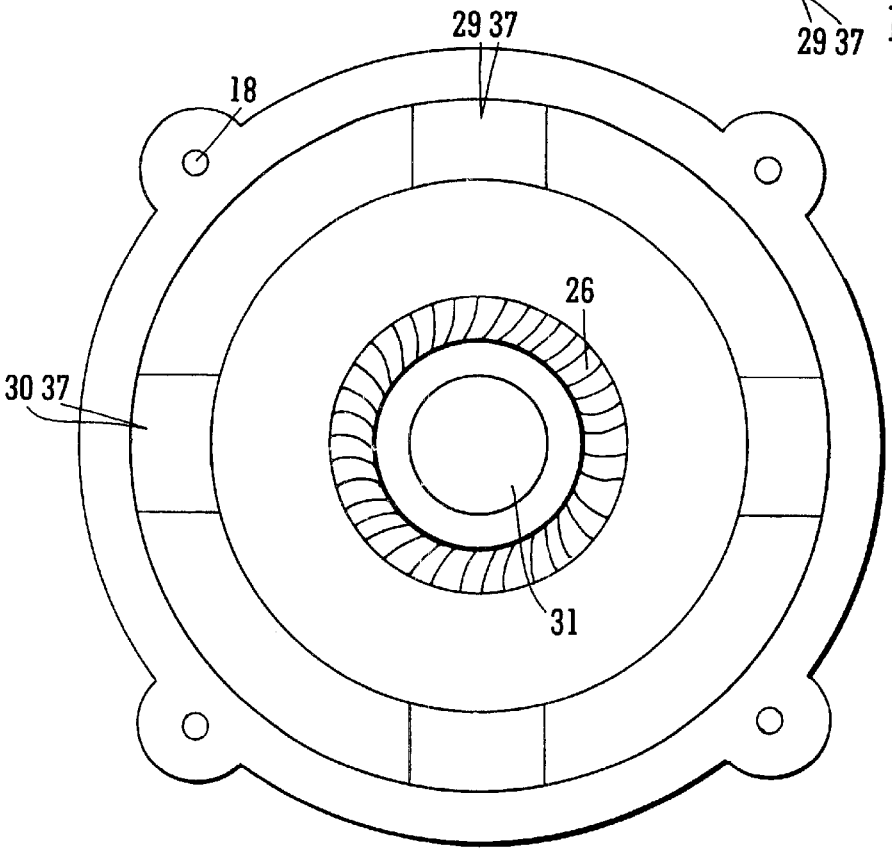
FIG. 11 shows the inside face view of a two cammed four stroked cycle, with pauses, front or back plate.

Also on the plates 27 are bearing holes 31 (FIG. 11) through which the rotor shaft 22 fits and bolt holes 18 to secure it to the engine block 16. Also provided on at least one plate 27 is a stationary part of the vaned rotor pump 26.

The rotating half of the vaned rotor pump 26 is provided on the main rotor's shaft 22, opposed to the stationary fixed vaned rotor on the cylinder's front or back plate 27 such that the vaned rotor pump 26 can supply either oil or air pressure for lubrication.

Figure 9:
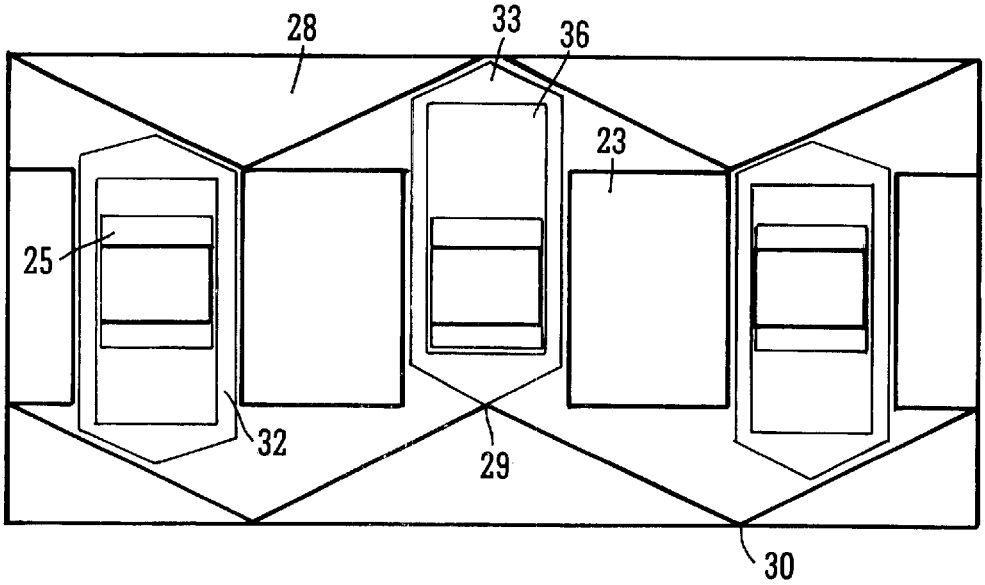
FIG. 9 shows a representation of the working parts unrolled and laid out flat, of a four stroked cycle version without pauses.
Figure 10:
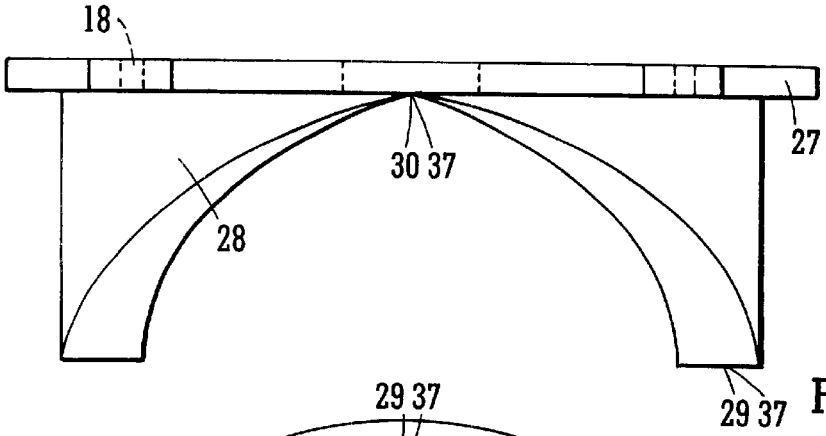
FIG. 10 shows a side view of the two cammed four stroked cycle, with pauses, front or back plate.
Figure 12:
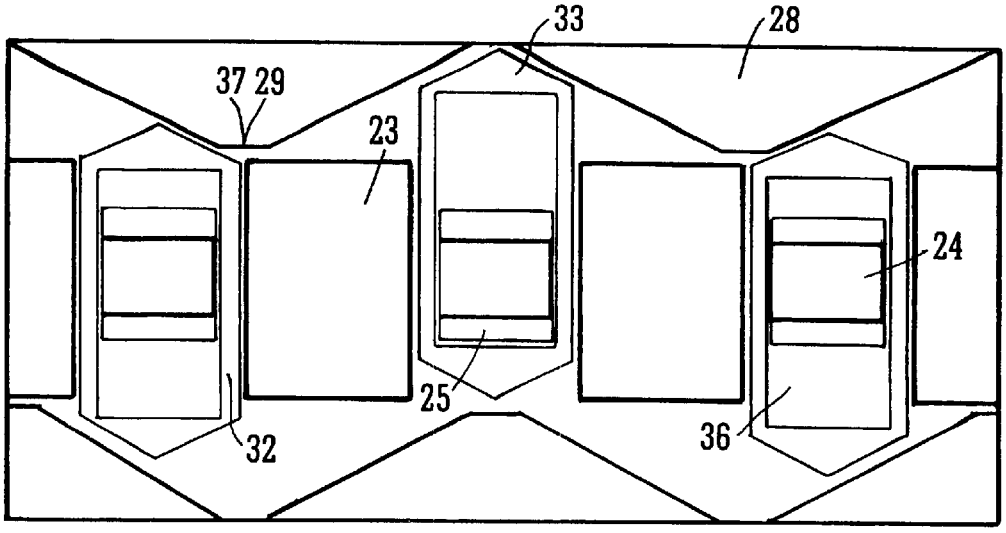
FIG. 12 shows a representation of the working parts unrolled and laid out flat, of a four stroked cycle version with pauses.
Figure 15:
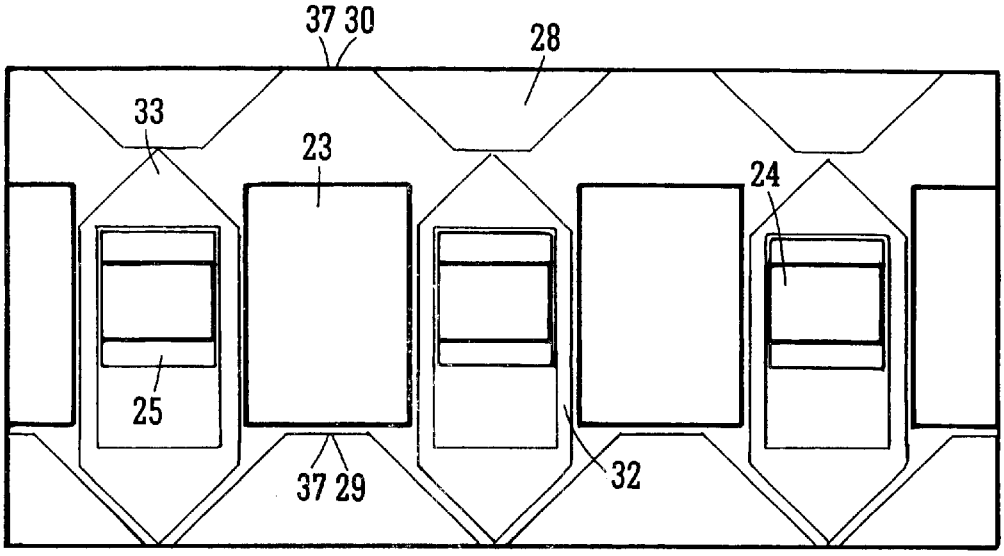
FIG. 15 shows a representation of the working parts unrolled and laid out flat, of a six stroked cycle version with pauses.
Figure 13:
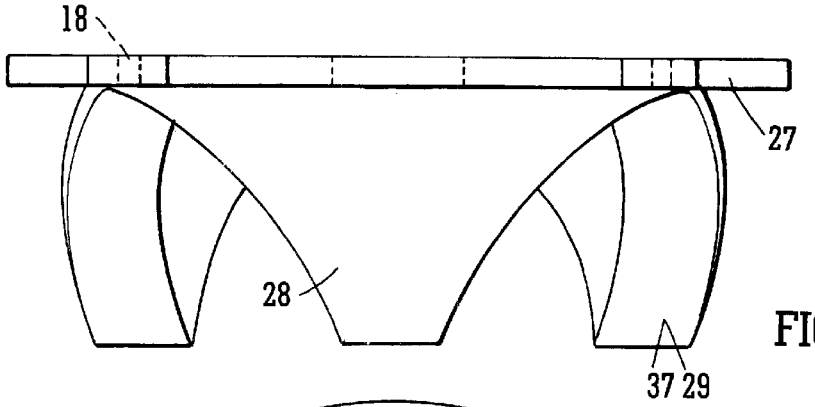
FIG. 13 shows a side view of a three cammed six stroked cycle, with pauses, front or back plate.
Figure 14:
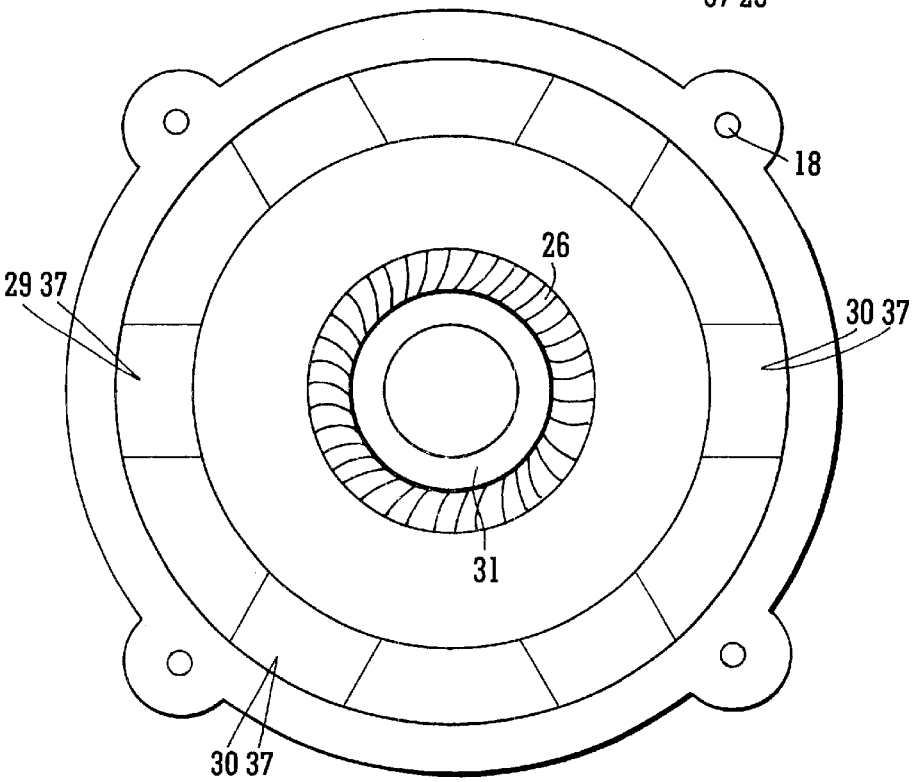
FIG. 14 shows the inside face view of a three cammed six stroked cycle, with pauses, front or back plate.

The pistons 32 have at their ends cam followers 33 which, when in contact with the cams 28, drive the rotor 21 forward in the direction of rotation, by the action of the pistons 32 against the blanks 23, and guide the pistons 32 reciprocating motion across the surface of the rotor 21 with the combustion chamber blocks 24 in the space defined within the pistons 32 affording compression and expansion, forming the combustion chamber 36 (see FIGS. 8, 9 and 12).

Figure 5:
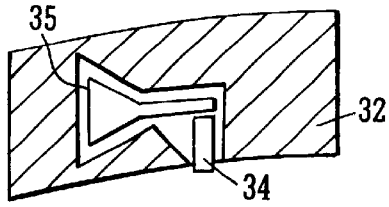
FIG. 5 shows a representation of the centrifugal device for the inside piston ring or rings.
Figure 6:
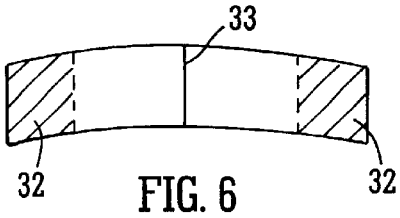
FIG. 6 shows an end view (arc) of the basic Draw piston.
Figure 6A:
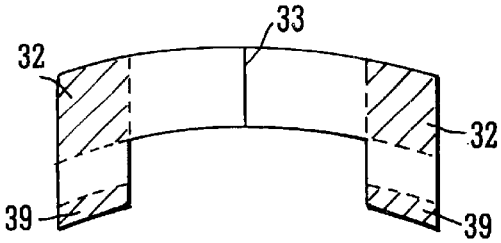
FIG. 6*a* shows an end view (arc) of the Draw piston with counterbalance rail.
Figure 7:
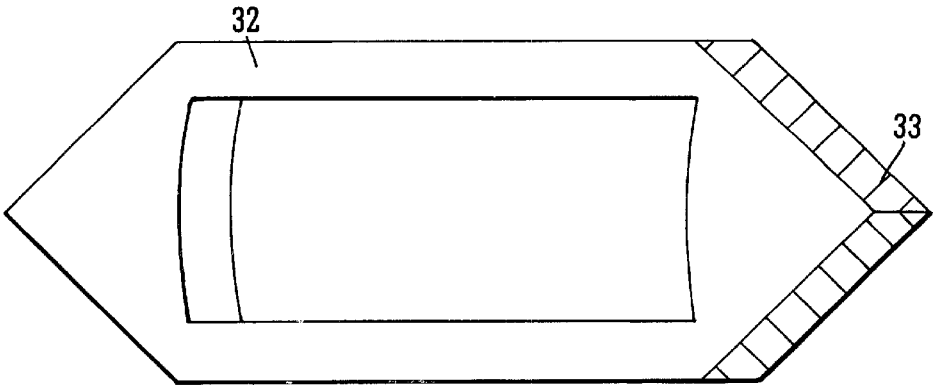
FIG. 7 shows a top view of the basic Draw piston.
Figure 7A:
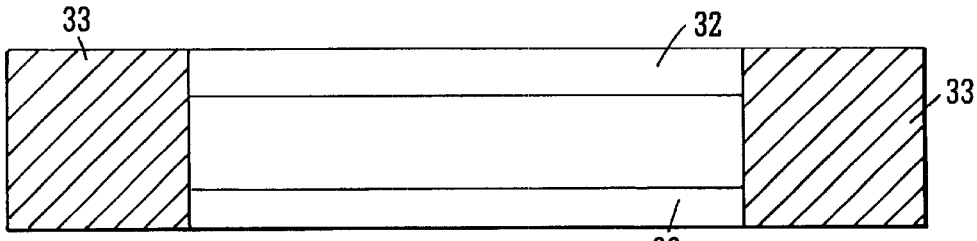
FIG. 7*a* shows a side view of the Draw piston with counterbalance rail.

As shown in FIG. 5, inner piston rings 32 are provided for sealing the gap between the pistons 32 and the rotor 21. The pistons 32 are provided with a centrifugal device 35 for their inner piston rings 34, to maintain a gas tight seal in the opposite direction of the centrifugal force. The centrifugal device 35 is heavier at one end than the other, either pivoting on part of the piston 32, or rotating on a shaft (not shown), so that the centrifugal force pushes out the heavy end in the direction of the centrifugal force, and forcing the lighter end, and thereby the piston ring 34 it is in contact with, in the opposite direction to the centrifugal force, affording a gas tight seal, equal or proportionate to, the centrifugal force.

Figure 16:
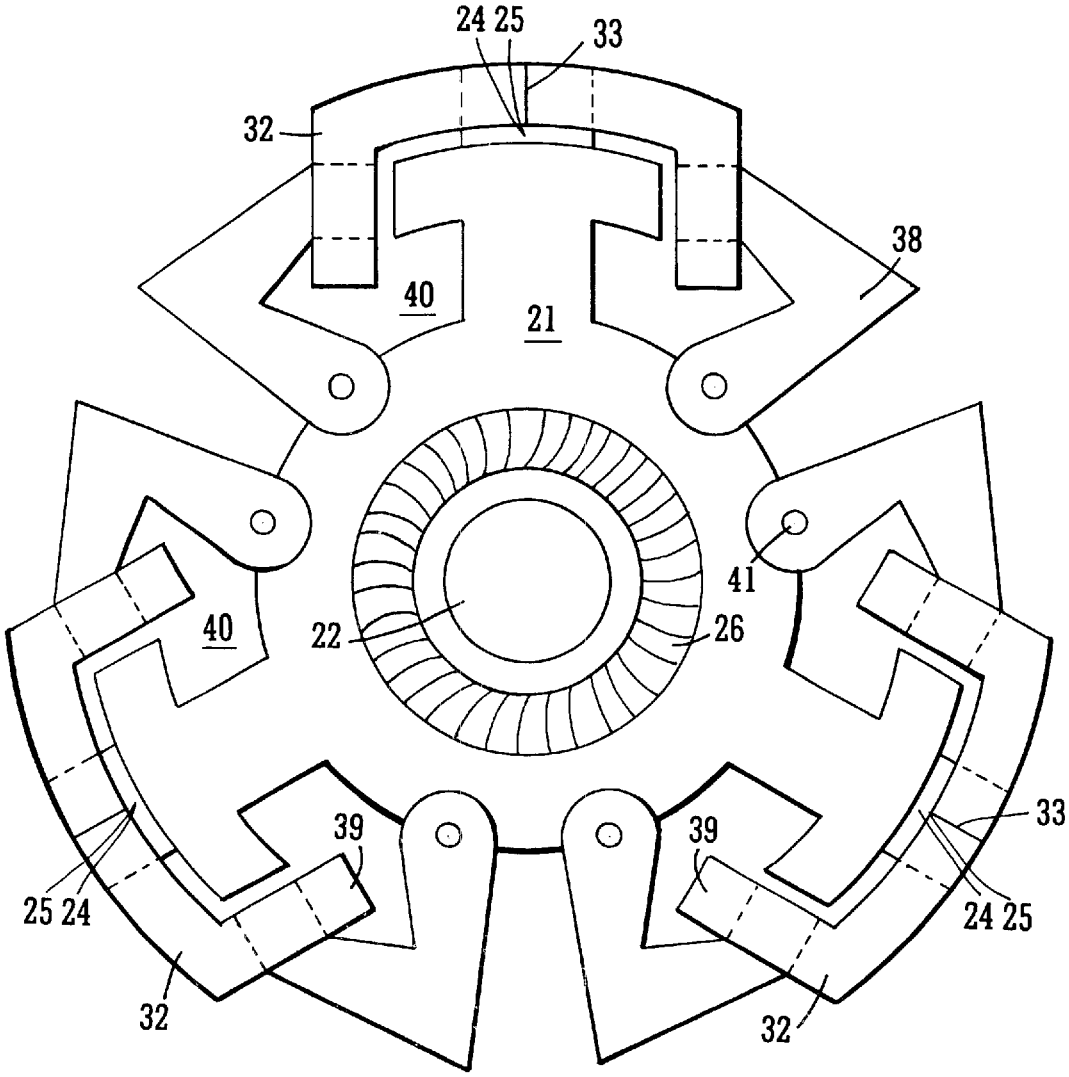
FIG. 16 shows an end view of a rotor with recesses for counterbalances. The Draw pistons with counterbalance rails, and the counterbalances in position.
Figure 17:
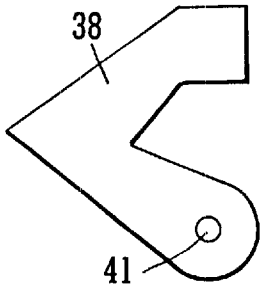
FIG. 17 shows a counterbalance weight.

As shown in FIGS. 16 and 17, the blanks 23 of the rotor 21 can be recessed 40 to take counterbalance weights 38 held by pins 41 to rotor body 21 and pistons 32 can have guide rails 39 added to take the counterbalance weights. Such an arrangement allows the centrifugal force produced by the pistons 32 during rotation of the rotor 21 to be transferred to the rotor 21 via the counterbalance weights 38.

What is claimed is:

1. A reciprocating piston rotary engine comprising at least one reciprocating piston held on a rotor, the or each piston rotating concentrically with the rotor, inside a annulus formed by the rotor and a non revolving cylindrical engine block which has means of ignition and means for the inlet and exhaust of gases, and where the or each piston reciprocates along the rotor, at an angle parallel with the rotational axis of the rotor and at right angles to the direction of rotation of the rotor, and where the or each piston forms three sides of a combustion chamber, the rotor forming two more sides and the cylindrical engine block forms the sixth, the or each piston driving the rotor by pushing against it and motions of compression and expansion of the or each piston being guided by cams which are situated on front and back plates of the circular cylinder engine block and where the or each piston reciprocates on a path at right angles to the direction of the centrifugal force to the rotor and is held in position by the rotor in the direction of rotation.

2. The reciprocating piston rotary engine of claim 1, wherein the shape, size and position and number of heads of each cam situated upon the front and back plates of the circular cylinder engine block can be selected to enable the or each piston to have a two, four or six stroke combustion cycle, with one or more cycles per revolution of the rotor where the fifth and sixth strokes are used as a flushing stroke and second exhaust stroke and for cooling purposes.

3. The reciprocating piston rotary engine of claim 1, wherein the cams can vary in number, size, position and shape to allow for the or each piston to pause for variable lengths between strokes of a combustion cycle to allow for combustion time lags and exhaust time lags.

4. The reciprocating piston rotary engine of claim 1, wherein the or each piston has a rail attached for the purpose of being counterbalanced.

5. The reciprocating piston rotary engine of claim 1, wherein a centrifugal device is fitted within the or each piston, the or each centrifugal device is heavier at one end than the other and either pivots on part of the or each piston or rotates of a shaft so that the centrifugal force pushes out the heavier end of the or each centrifugal device in the direction of the centrifugal force of the or each piston and forces the lighter end of the or each device, and thereby a piston ring, with which it is in contact, in the opposite direction to the centrifugal force of the or each piston affording a gas tight seal equal or greater than the centrifugal force of the piston.

6. A reciprocating piston rotary engine comprising at least one reciprocating piston held on a rotor, the or each piston rotating concentrically with the rotor, inside a annulus formed by the rotor and a non revolving cylindrical engine block which has means of ignition and means for the inlet and exhaust of gases, and where the or each piston reciprocates along the rotor, at an angle parallel with the rotational axis of the rotor and at right angles to the direction of rotation of the rotor, and where the or each piston forms three sides of a combustion chamber, the rotor forming two more sides and the cylindrical engine block forms the sixth, the or each piston driving the rotor by pushing against it and motions of compression and expansion of the or each piston being guided by cams which are situated on front and back plates of the circular cylinder engine block and where the or each piston reciprocates on a path at right angles to the direction of the centrifugal force to the rotor and is held in position by the rotor in the direction of rotation wherein the rotor has recesses for the purpose of housing at least one counterbalance weight for the or each piston and where the or each counterbalance weight is attached to the rotor.

7. The reciprocating piston rotary engine of claim 6 where the or each piston is held in position by the rotor in the direction of rotation by either the cylindrical engine block, or by the or each counterbalance weight against the direction of centrifugal force or by part of the rotor against the direction of centrifugal force, or any combination thereof.

8. A reciprocating piston rotary engine comprising at least one reciprocating piston held on a rotor, the or each piston rotating concentrically with the rotor, inside a annulus formed by the rotor and a non revolving cylindrical engine block which has means of ignition and means for the inlet and exhaust of gases, and where the or each piston reciprocates along the rotor, at an angle parallel with the rotational axis of the rotor and at right angles to the direction of rotation of the rotor, and where the or each piston forms three sides of a combustion chamber, the rotor forming two more sides and the cylindrical engine block forms the sixth, the or each piston driving the rotor by pushing against it and motions of compression and expansion of the or each piston being guided by cams which are situated on front and back plates of the circular cylinder engine block and where the or each piston reciprocates on a path at right angles to the direction of the centrifugal force to the rotor and is held in position by the rotor in the direction of rotation, wherein the or each piston is arc shaped over its width and straight over its length, has cam followers at its ends and a hollow centre, the or each piston forming two combustion chambers with a combustion chamber ignition block formed on the rotor, one combustion chamber formed on either side of the combustion chamber ignition block alternately while the or each piston reciprocates along the length of the rotor.

* * * * *